US012669021B2

(12) United States Patent
Grillo et al.

(10) Patent No.: US 12,669,021 B2
(45) Date of Patent: Jun. 30, 2026

(54) COLLAPSIBLE CASING TIGHTENER AND METHOD OF USE

(71) Applicant: Keller North America, Inc., Hanover, MD (US)

(72) Inventors: John R. Grillo, Midland Park, NJ (US); Justin Lukens, Lansdale, NJ (US)

(73) Assignee: Keller North America, Inc., Hanover, MD (US)

( * ) Notice: Subject to any disclaimer, the term of this patent is extended or adjusted under 35 U.S.C. 154(b) by 0 days.

(21) Appl. No.: 19/098,555

(22) Filed: Apr. 2, 2025

(65) Prior Publication Data

US 2025/0320784 A1 Oct. 16, 2025

Related U.S. Application Data

(60) Provisional application No. 63/632,127, filed on Apr. 10, 2024.

(51) Int. Cl.
*E21B 19/16* (2006.01)

(52) U.S. Cl.
CPC ..... *E21B 19/16* (2013.01)

(58) Field of Classification Search
CPC ..... E21B 19/16
See application file for complete search history.

(56) References Cited

U.S. PATENT DOCUMENTS 2,687,323 A * 8/1954 Stohn ..... E21B 31/18 294/86.21
4,442,907 A * 4/1984 Sexton ..... E21B 19/16 166/85.1
6,161,617 A * 12/2000 Gjedebo ..... E21B 19/07 166/380
6,702,040 B1 3/2004 Sensenig
6,732,822 B2 * 5/2004 Slack ..... E21B 23/006 166/216
7,284,617 B2 * 10/2007 Pietras ..... E21B 19/07 166/85.1
7,909,120 B2 3/2011 Slack
(Continued)

FOREIGN PATENT DOCUMENTS

EP 3260651 B1 1/2019
WO WO-2018107095 6/2018

*Primary Examiner* — Steven A Macdonald
(74) *Attorney, Agent, or Firm* — Steven Scott Lloyd

(57) ABSTRACT

A collapsible casing tightener comprising an outer body with hollow cylindrical main section open at one end and closed at the other at a shoulder. A reduced neck protrudes from the shoulder to a collar for attachment to a drill rig. The cylindrical main section is defined by a radial array of angularly spaced notches each comprising a narrow aperture through the wall. Internally, a hollow pipe section extends coaxially within from the neck to a distal cylindrical receptacle with a threaded female joint. An extendable inner body is telescopically inserted into the outer body between the cylindrical main section and hollow pipe section, the inner body having pins affixed therein and carried within the notches for guided extension. The collapsible casing tightener replaces time consuming, inefficient hand tightening of multiple drill rod segments and casing segments with a wrench with telescopic extension and retraction followed by drill-assisted rotation.

10 Claims, 7 Drawing Sheets

(56) References Cited

U.S. PATENT DOCUMENTS

| | | | | |
|---|---|---|---|---|
| 8,281,877 | B2 | 10/2012 | Shahin et al. | |
| 8,684,851 | B2 * | 4/2014 | Slack | E21B 17/07 464/163 |
| 8,783,339 | B2 * | 7/2014 | Sinclair | E21B 17/00 166/85.1 |
| 9,416,601 | B2 * | 8/2016 | Mullins | E21B 19/07 |
| 9,845,650 | B2 * | 12/2017 | Evans | E21B 43/10 |
| 9,896,891 | B2 * | 2/2018 | Mullins | E21B 3/022 |
| 9,932,785 | B2 * | 4/2018 | Frith | E21B 19/24 |
| 10,041,311 | B2 * | 8/2018 | In | E21B 17/03 |
| 10,316,588 | B1 * | 6/2019 | Robertson | F01D 1/04 |
| 10,385,632 | B1 * | 8/2019 | Mullins | E21B 31/20 |
| 10,526,852 | B2 * | 1/2020 | Wiens | E21B 17/023 |
| 10,544,631 | B2 * | 1/2020 | Reinecke | E21B 19/16 |
| 10,858,896 | B2 * | 12/2020 | Jones | E21B 7/00 |
| 11,299,940 | B2 * | 4/2022 | Slack | E21B 3/022 |
| 11,332,985 | B1 * | 5/2022 | Slack | E21B 19/07 |
| 11,560,761 | B2 * | 1/2023 | Slack | E21B 31/20 |
| 2001/0042625 | A1 * | 11/2001 | Appleton | E21B 3/022 166/381 |
| 2002/0060078 | A1 * | 5/2002 | Cook | E21B 33/10 166/207 |
| 2003/0164276 | A1 * | 9/2003 | Snider | E21B 19/165 192/70.27 |
| 2004/0216924 | A1 * | 11/2004 | Pietras | E21B 19/00 166/380 |
| 2008/0210063 | A1 * | 9/2008 | Slack | E21B 19/06 81/420 |
| 2009/0273201 | A1 * | 11/2009 | Slack | E21B 19/07 294/86.25 |
| 2014/0076538 | A1 * | 3/2014 | Shute | E21B 3/022 166/177.4 |
| 2017/0204678 | A1 * | 7/2017 | Drenth | E21B 17/042 |
| 2021/0355764 | A1 * | 11/2021 | Slack | E21B 19/16 |
| 2023/0392335 | A1 * | 12/2023 | Gempler | E02D 3/103 |
| 2024/0418043 | A1 * | 12/2024 | Slack | E21B 43/10 |

* cited by examiner

COLLAPSIBLE CASING TIGHTENER AND METHOD OF USE

CROSS REFERENCE TO RELATED APPLICATIONS

This application claims the benefit of priority of U.S. Provisional Pat. App. Ser. No. 63/632,127, filed Apr. 10, 2024, the contents of which are incorporated herein in their entirety.

BACKGROUND OF THE INVENTION

The present invention relates to casing advancement systems for overburden and rock drilling in difficult ground conditions and, more particularly, to a collapsible casing tightener and method of use to load casing and drill rod sections which are required to have opposite threading directions (counter threaded). The present invention allows the user to avoid the use of time-consuming welded joints, manually tightening the threaded joints with hand tools in a safer and more expeditious manner, where traditional micro-pile duplex techniques cannot be used. A drill string is typically comprised of an outer casing (typically steel) and inner drill rod which holds the drilling bit. The most common type of drill utilized for this drilling methodology is fitted with a single drill head capable of rotation in a single direction at a time.

Casing advancement systems are a specific method of drilling used for simultaneous drilling of casing and drill rod advancing concurrently in which the casing is attached to the drill string at the bottom through an integrated locking ring bit. Casing advancement is often utilized in difficult unstable ground conditions. Consequently, systems for integrated drill advancement and casing advancement are widely used for geothermal well drilling, water well drilling, tunneling, foundation work, and anchoring. For example, a ring drill bit is attached to the first casing section, and a pilot drill bit is attached to the drill rod and engaged with the ring drill bit, thereby creating an integrated casing and drill bit head that drills a concentric bore into earth. While drilling with a casing advancement system the inner drill rod rotates and pulls the casing down into the earth from the bottom where they are connected. Drill spoils are evacuated in the annular space between the inside of the casing and the outside of the of the drill string. The evacuation of drill spoils is an integral part of drilling. During use of casing advancement systems, the spoils are evacuated at the top of the drill string through the gap between the drill head and the top of the drill casing. The present invention's collapsible nature is a key component which allows for the mechanical tightening to the casing to be performed by the drill rig, whilst still providing the gap in the top of the drill string for spoils evacuation while utilizing a single drill head.

To achieve the required depths, it is typical to insert multiple segments of casing and inner drill rods which comprise the "drill string." After drilling the first casing and drill rod segment, the drill rig is disconnected, another casing and drill rod segment is attached to the inserted segment, and the rig reattached. Thus, each successive casing section and drill rod section must be "loaded" with another section overtop the borehole and attached (screwed, welded, etc.) to the sections below. This process is repeated until all casing segments and drill segments are run.

The most common type of casing and drill segments utilized have threaded joints which the drill rig screws together. With casing advancement drilling the thread direction of the inner drill string is required to be opposite of that of the outer drill string. This is a result of the forces applied to the outside wall of the casing during drilling. For example, while the inner drill string is turning right, the integrated ring bit will also turn right as they are firmly attached. Soil particles in the ring bit may present enough friction to bind the free-rotating nature of the ring bit and cause rotational forces to result in the leading section of casing spinning. If the casing is threaded the same direction as the rotation, friction from soil above the bottom of the borehole, acting to counter the rotational forces will result in loosening or complete un-threading of the outer casing. This end result can be catastrophic for drilling. The solution for this is the have thread direction of the casing and inner drill string in opposite directions. This presents a problem when loading the casing and inner drill string, and tightening the next pieces to those previously drilled. To overcome this, the Invention provides a collapsible length in which both the inner and outer section of the drill string are able to be threaded consecutively without requiring cumbersome secondary equipment or timely casing jointing procedures such as penetration welding.

Unfortunately, both casing segments and drill rod segments are very large and heavy, and the loading process is labor intensive, creates safety issues, and is very prone to misalignment/tolerance problems. One approach to solving these problems is to provide other equipment to lift and manipulate segments. For example, U.S. Pat. No. 8,281,877 to Shahin et al. (Weatherford Technology Holdings LLC) shows a top drive adapter for drilling with casing with integral arm for manipulating casing sections.

U.S. Pat. No. 7,909,120 to M. W. Slack (Noetic Engineering Inc.) shows a casing running tool (CRT) gripping tool for hoisting casing segments that moves from a retracted position to an engaged position.

Another approach is to use telescoping segments. For example, European Patent EP3260650 to Dieter et al. (Geosea NV) shows a device and method for drilling a subsea shaft using a lockable, telescoping casing driver to accommodate ocean swells. The casing tube 4 comprises a first part 4*a* and a second part 4*b* telescopically displaceable relative to each other and lockable by pins in slots (5, 6).

International Application No. WO2018107095 by Deberry et al. (Dril-Quip, Inc.) shows a CRT adapter with a telescopic member 230 shown in FIGS. 2D and 2E. When it is time to connect the last casing joint 212, the telescopic member 230 of the adapter 210 may be extended to engage with the casing 212 at a position below the attached well equipment 214.

U.S. Pat. No. 6,702,040 issued to Floyd Sensenig teaches a telescopic drilling method with outer casing section 64 (FIG. 4) and inner casing 70 telescopically inserted into the outer casing 64.

The difficulties inherent in the drill and casing insertion process are compounded when installing casing/drill rod sections in a restricted space (e.g., with limited headroom). Low headroom constrains the length of the segments, increases the number of segments that must be attached end-to-end, and confines the surrounding space for manipulating the segments. Again, casing segments are very heavy, and screwing together is time consuming (threaded casing sections must be hand tightened with a chain wrench). All of this is labor intensive, and each transport of the next casing segment containing the next drill rod segment is often precarious and can result in human injury. None of the foregoing prior art efforts provide any solution in the confined space or limited headroom context, and so what is needed is a collapsible casing tightener and method of use for simultaneous drilling and casing installation that makes it easier to load casing and drill rod sections where casing advancement systems with integrated ring bits are being employed where traditional micropile duplex techniques cannot be used.

BRIEF SUMMARY OF THE INVENTION

It is an object of the invention to provide a collapsible casing tightener and method of use for installing casing/drill rod sections when casing advancement systems are being utilized.

In accordance with the foregoing object, the invention is a collapsible casing tightener comprising an outer body having a hollow cylindrical main section open at one end and leading to a shoulder at another end. The shoulder leads to a reduced neck that leads to a collar for attachment to a drill rig. The main section of the outer body is defined by a radial array of angularly spaced notches, each comprising a narrow aperture through a wall of the main section. A hollow pipe section extends coaxially within the cylindrical main section, is attached at one end to the neck, and at the other end has a distal cylindrical receptacle with a threaded female joint. An extendable inner body is telescopically inserted into the outer body between the cylindrical main section and hollow pipe section, the inner body having a plurality of pins affixed therein and carried within the notches for guided extension. The collapsible casing tightener eliminates labor-intensive, time-consuming hand tightening of multiple drill rod segments and casing segments with a chain wrench, instead requiring only telescopic extension and retraction followed by drill-assisted rotation.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE INVENTION

Figure 1:
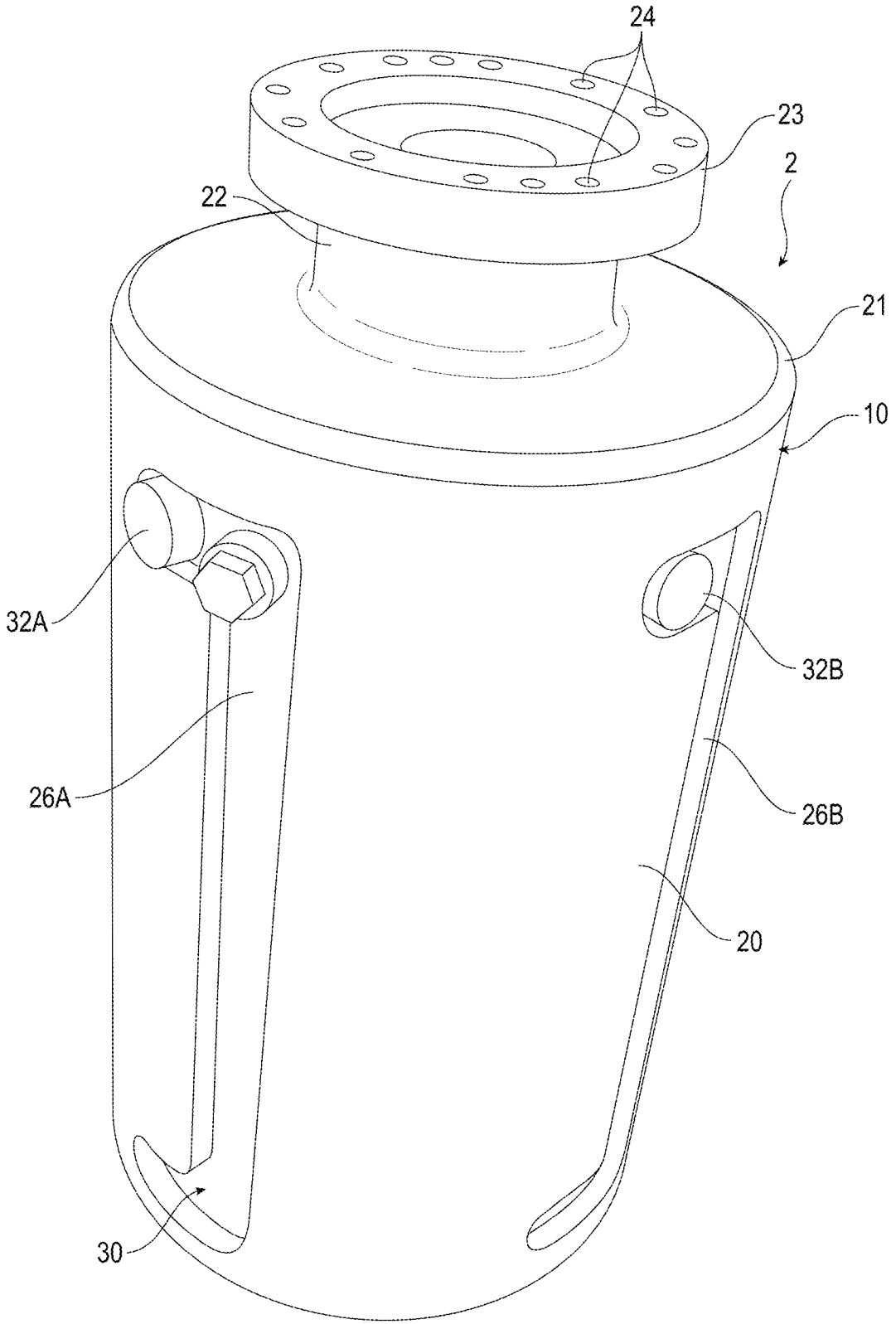
FIG. 1 is a front perspective view of a collapsible casing tightener according to an embodiment of the invention.
Figure 2:
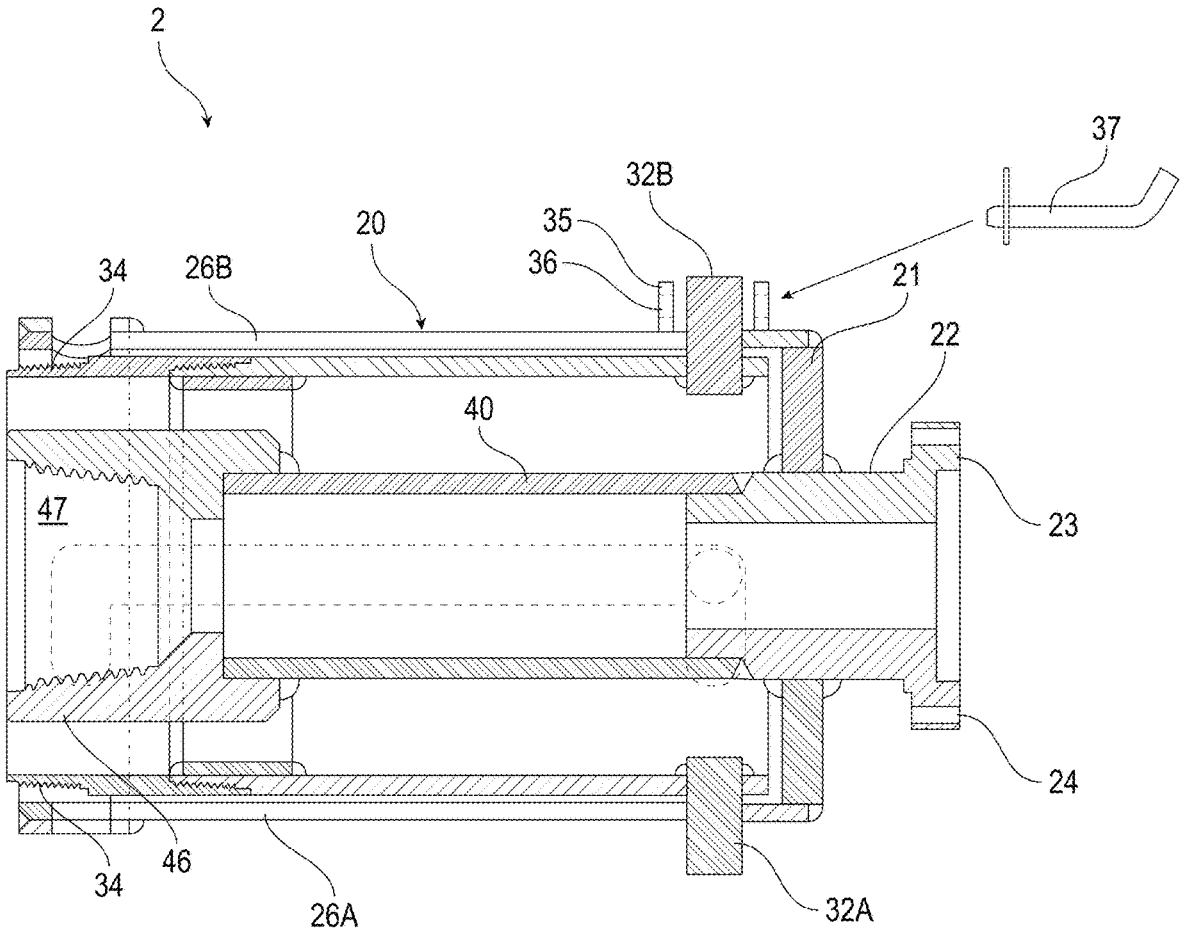
FIG. 2 is a side cross-section of the collapsible casing tightener of FIG. 1.
Figure 3:
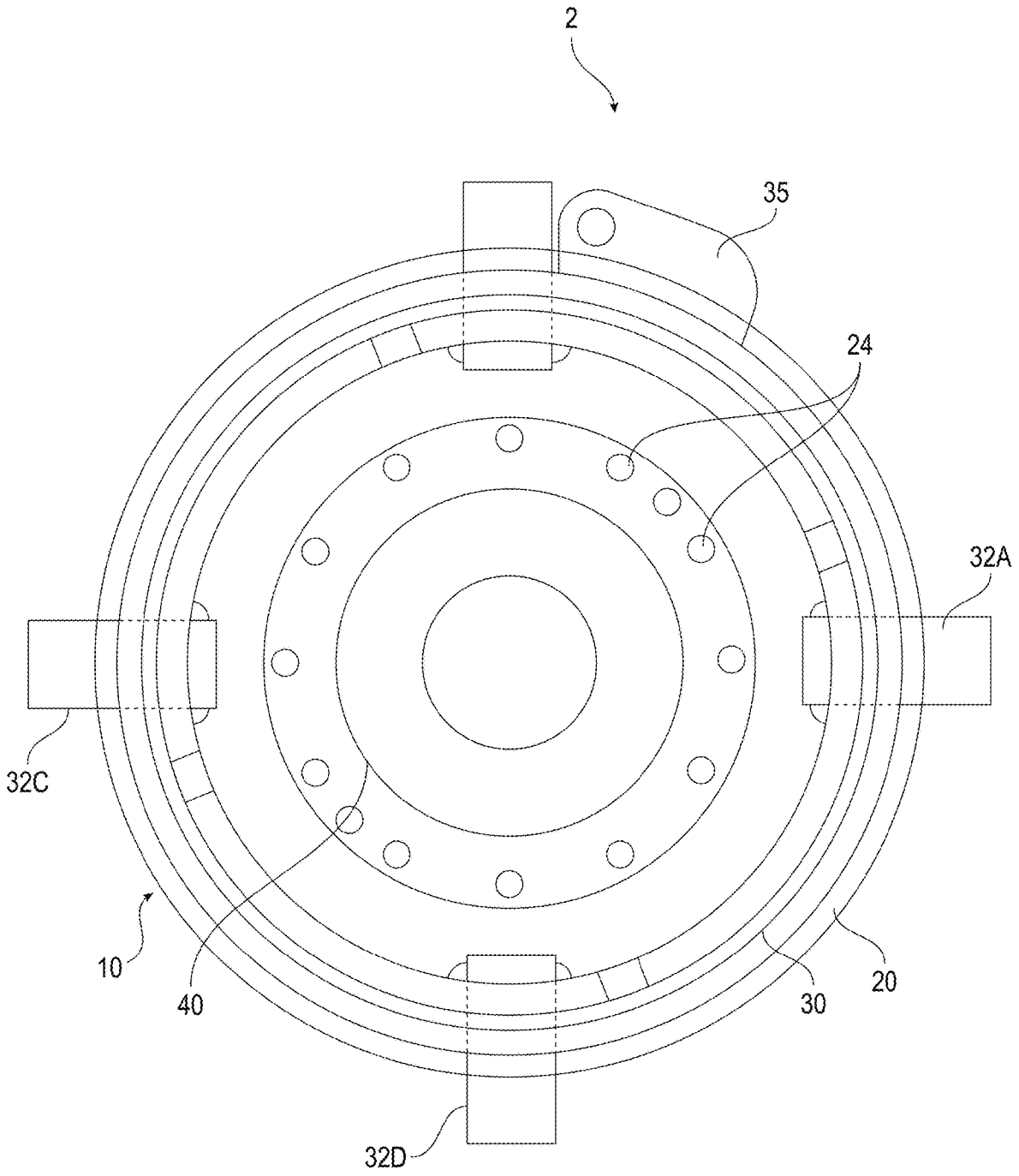
FIG. 3 is an overhead x-ray view of the collapsible casing tightener of FIG. 1.
Figure 4:
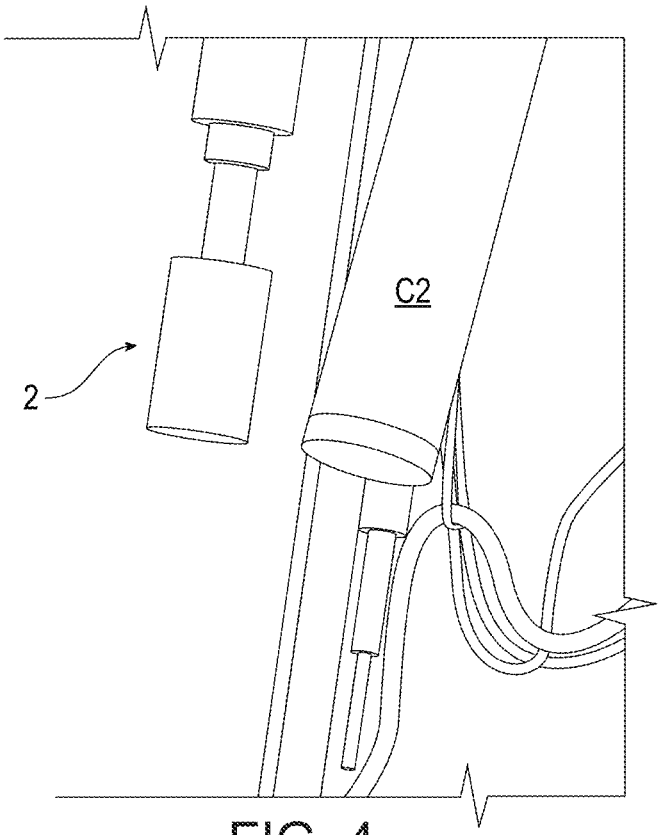
FIG. 4 is a process drawing illustrating a first step of the method if using the collapsible casing tightener of FIGS. 1-3.

The present invention is that of a collapsible casing tightener and method of use for installing casing sections and drill rod sections. As seen in FIGS. 1-3, the collapsible casing tightener 2 includes an outer body 10 having a hollow cylindrical main section 20 leading to a shoulder 21 at one end, shoulder 21 leading to a section of reduced neck 22, which in turn leads to a distal ring-like collar 23. The collar 23 is defined by a radial array of angularly spaced upward-facing non-threaded joints 24 for bolt-attachment to a conventional drill rig. The main section 20 of outer body 10 is also defined by a radial array of angularly spaced notches, preferably four notches 26A-D as shown in FIG. 3, each notch comprising a narrow aperture through the wall of main section 20. Each notch comprises a lengthwise elongate segment running a majority of the length of main section 20 and two short segments extending at approximately a right angle from a terminus end of a lengthwise elongate segment.

An extendable inner body 30 is telescopically inserted into the hollow of the cylindrical main section 20 of outer body 10, and pins 32A-D are affixed into the extendable inner body 30 and carried within notches 26A-D for guided extension (preferably four pins 32A-D corresponding to four notches 26A-D).

The pins 32A-D delimit and guide telescopic extension of inner body 30 from a fully retracted position (shown) to a fully extended position as will be described, and the short segments of notches 26A-D retain the extendable body 30 in one of the fully retracted position or fully extended position.

As seen in FIG. 2 a safety lock is provided for at least one of the four notches 26A-D, the safety lock comprising opposing flanges 35 flanking the uppermost short segment of notch 26B, both opposing flanges 35 containing a through hole 36 for insertion of a hitch pin 37. When inserted, the hitch pin 37 straddles the two flanges 35 and blocks the pin 32B from entering the lengthwise segment of notch 26B, thereby preventing inadvertent extension.

As seen in FIG. 2 the extensible end of inner body 30 is formed with a male threaded joint 34 compatible with conventional casing sections. In the preferred embodiment, threaded joint 34 comprises a frustoconical tapered surface screw-threaded along its length. The frustoconical shape provides a wedging effect. However, one skilled in the art will understand that non-tapered threads are suitable, in which case the threaded joint 34 is of uniform cylindrical cross-section screw-threaded along a length of inner body 30. Importantly, the extendable body 30 extends a first distance Tr outward of the cylindrical main section 20 of outer body 10 when in the fully retracted position (as shown). The extendable body 30 extends a larger distance Te outward of the cylindrical main section 20 of outer body 10 when in the fully extended position.

The neck 22 is attached to the shoulder 21 by welding or the like and continues through the shoulder 21 to the interior of main body 20 where it is attached to a hollow pipe section 40. Pipe section 40 continues to a distal cylindrical receptacle 46 having a threaded female joint 47. The receptacle 46 comprises a thicker cylindrical section of uniform exterior dimension formed with the female joint 47. The female joint 47 is a screw-threaded receptacle (again, tapered-conical, or non-tapered threads) open outward. The female joint 47 is shaped, dimensioned, and threaded for screw-insertion of a conventional drill rods (not shown) or, alternatively, for screw-insertion of another drill segment.

The entire outer body 10 inclusive of main section 20, neck 22, inner pipe section 40, and receptacle 46 with female joint 47 are all fixedly attached to each other as shown by weld joints or the like, and with inner pipe section 40 and receptacle 46 extending interiorly and coaxially through the main section 20 of outer body 10. On the other hand, the extendable body 30 is telescopically movable between the main section 20 of outer body 10 and pipe section 40/receptacle 46 interiorly and coaxially, pins 32A-D guiding extension, from the fully retracted position (shown) to a fully extended position.

The above-described collapsible casing tightener 2 is well-suited for low-headroom projects in addition to projects in which there are no headroom restrictions or confined spaces. For example, in a project to install many 16" micropiles under a viaduct, headroom may be limited to using 5' casing segments. The micropiles can be drilled using any suitable down-the-hole (DTH) hammer and a suitable casing advancement system, where the ring bit and pilot drill bit interlock, but after the casing sections are drilled to the desired depth the pilot bit is released by turning it backwards and then pulled up and used again in the next pile. When using casing advancement systems, the drill rod segments are typically right-hand-threaded for clockwise engagement whereas the casing segments are typically left-handed for counterclockwise engagement to prevent the friction between the ground and casing from unthreading while advancing the inner rod. A suitable clamping/breakout system is also used to clamp the casing segment and drill rod segments and break the string connections. For example, a double breakout clamp may be used to securely hold both casing segments and rod segments using two sets of clamps. Double breakout clamps are commonly used for tripping out both drill rods and threaded casings.

With reference to FIGS. 4-7, the method of using a collapsible casing tightener 2 proceeds as follows:

Step 1: Initially the collapsible casing tightener 2 is attached to the drill rig at collar 23 by bolt-attachment via non-threaded joints 24. A first segment of casing C1 and first section of drill rod D1 has already been drilled into the ground an D1 is below the upper clamp (all not shown).

Figure 5:
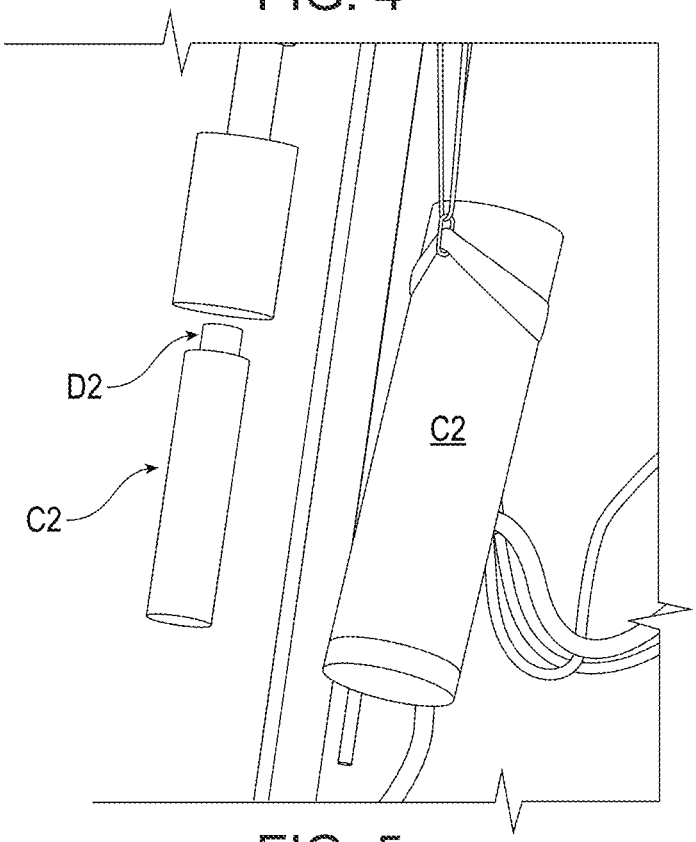
FIG. 5 is a process drawing illustrating a second step of the method if using the collapsible casing tightener 2 of FIGS. 1-3.

Step 2: As seen in FIG. 5, the next drill rod segment D2 is loaded into the collapsible casing tightener 2 and the drill rig/collapsible casing tightener 2 is engaged with the drill rod segment D2 and rotated clockwise into engagement with D1 (not shown) in the lower clamp. The drill rod segment D2 is hoisted is then disengaged by counterclockwise rotation and released from the collapsible casing tightener.

Figure 6:
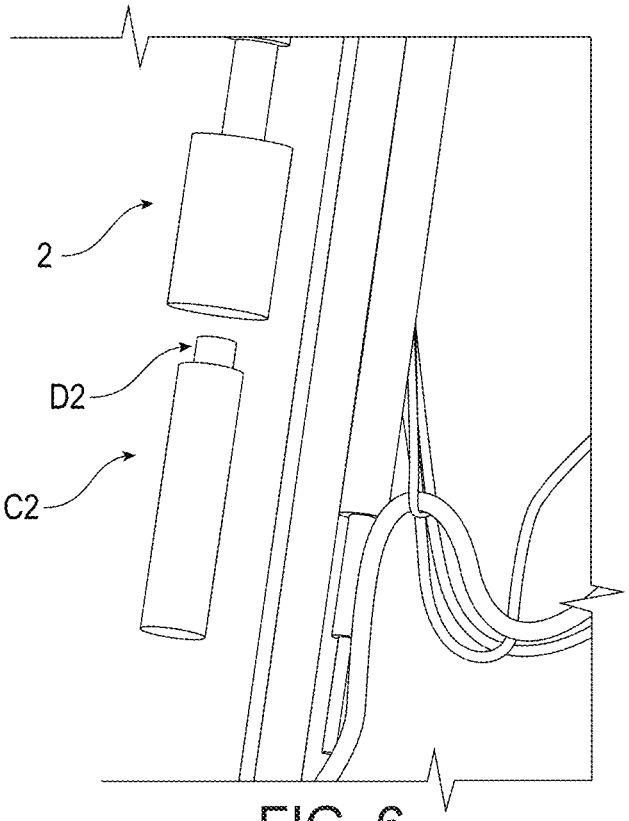
FIG. 6 is a process drawing illustrating a third step of the method if using the collapsible casing tightener 2 of FIGS. 1-3.

Step 3: as seen in FIG. 6 the casing segment C2 is inserted down overtop the drill rod segment D2. The drill rig/collapsible casing tightener 2 is lowered into engagement. The extendable inner body 30 of casing tightener 2 is telescopically extended (pins 32A-D guiding extension within notches 26A-D) from the fully retracted position to a fully extended position until the drill rig/collapsible casing tightener 2 can be engaged first with the casing segment C2. The extendable inner body 30 prevents the inner pipe section 40 from engaging with drill rod D2. The drill rig/casing tightener 2 is then rotated counter-clockwise to screw-engage casing segment C2 with the previously installed casing segment C1 (not shown).

Figure 7:
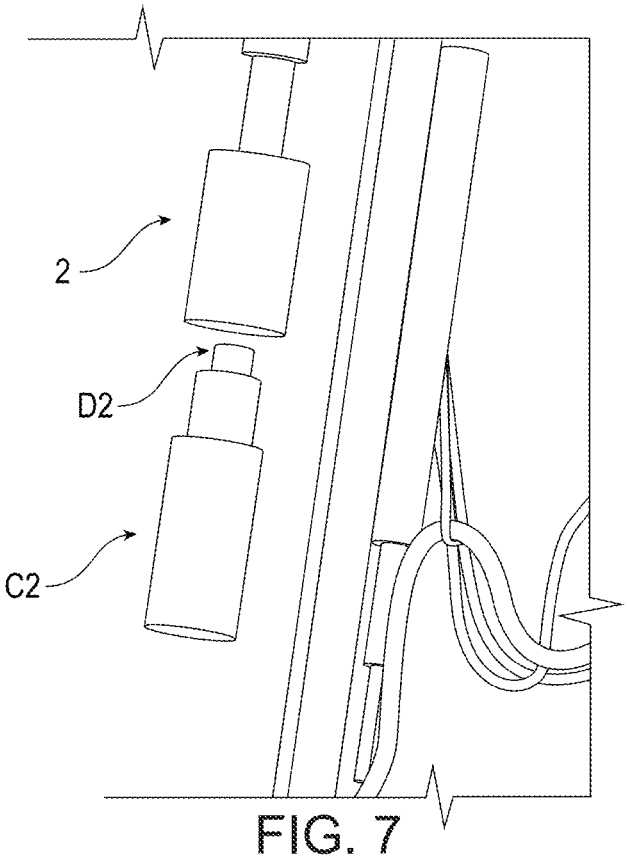
FIG. 7 is a process drawing illustrating a fourth step of the method if using the collapsible casing tightener 2 of FIGS. 1-3.

Step 4: as seen in FIG. 7 the extendable inner body 30 of casing tightener 2 is telescopically retracted to expose socket 36 cylindrical receptacle 46 (again, pins 32A-D guiding extension within notches 26A-D), and the drill rig/collapsible casing tightener 2 is advanced until the cylindrical receptacle 46 of drill rig/collapsible casing tightener 2 is advanced until the cylindrical receptacle 46 of drill reg/collapsible casing tightener 2 can be engaged first with the drill rod segment D2. The drill rig/casing tightener 2 is then rotated clockwise to screw-engage with drill rod segment D2. The drill rig/casing tightener 2 is then rotated clockwise to screw-engage with drill rod segment D2. The drill rig/casing tightener is now fully engaged to only drill rod segment D2 to advance the system into the ground.

Step 5: the process is repeated for as many drill rod segments D3 . . . n and casing segments C3 . . . n as necessary to form the desired micropile.

One skilled in the art should understand that the above-described casing tightener 2 and method of use eliminates labor-intensive, time-consuming hand tightening of multiple drill rod segments D1 . . . n and casing segments C1 . . . n with a chain wrench and instead requires only telescopic extension and retraction of casing tightener 2 and drill-assisted rotation from drill rig/casing tightener 2 to fully engage the drill rod.

Figure 8:
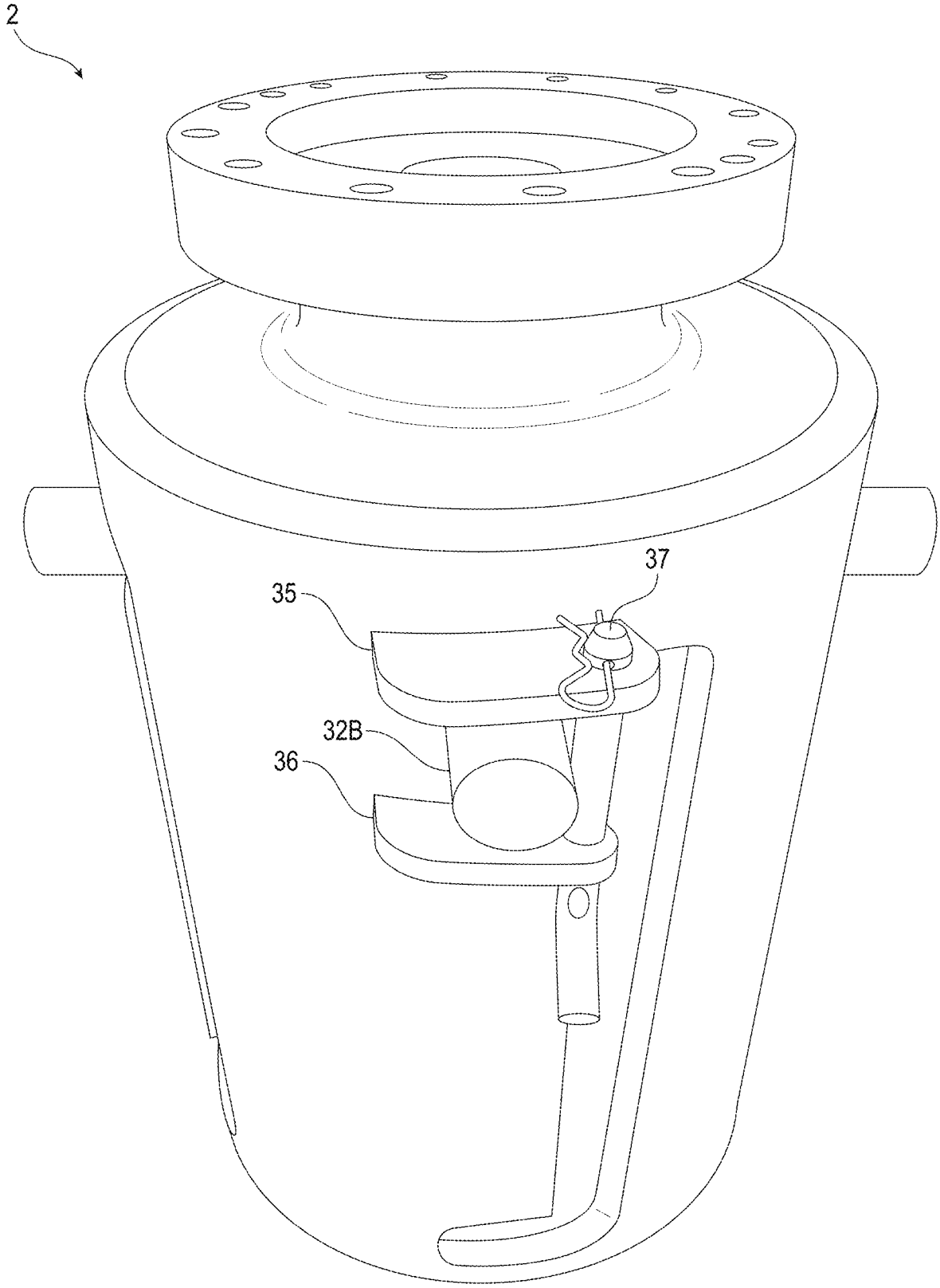
FIG. 8 is a right side perspective view of the collapsible casing tightener of FIGS. 1-3.
Figure 9:
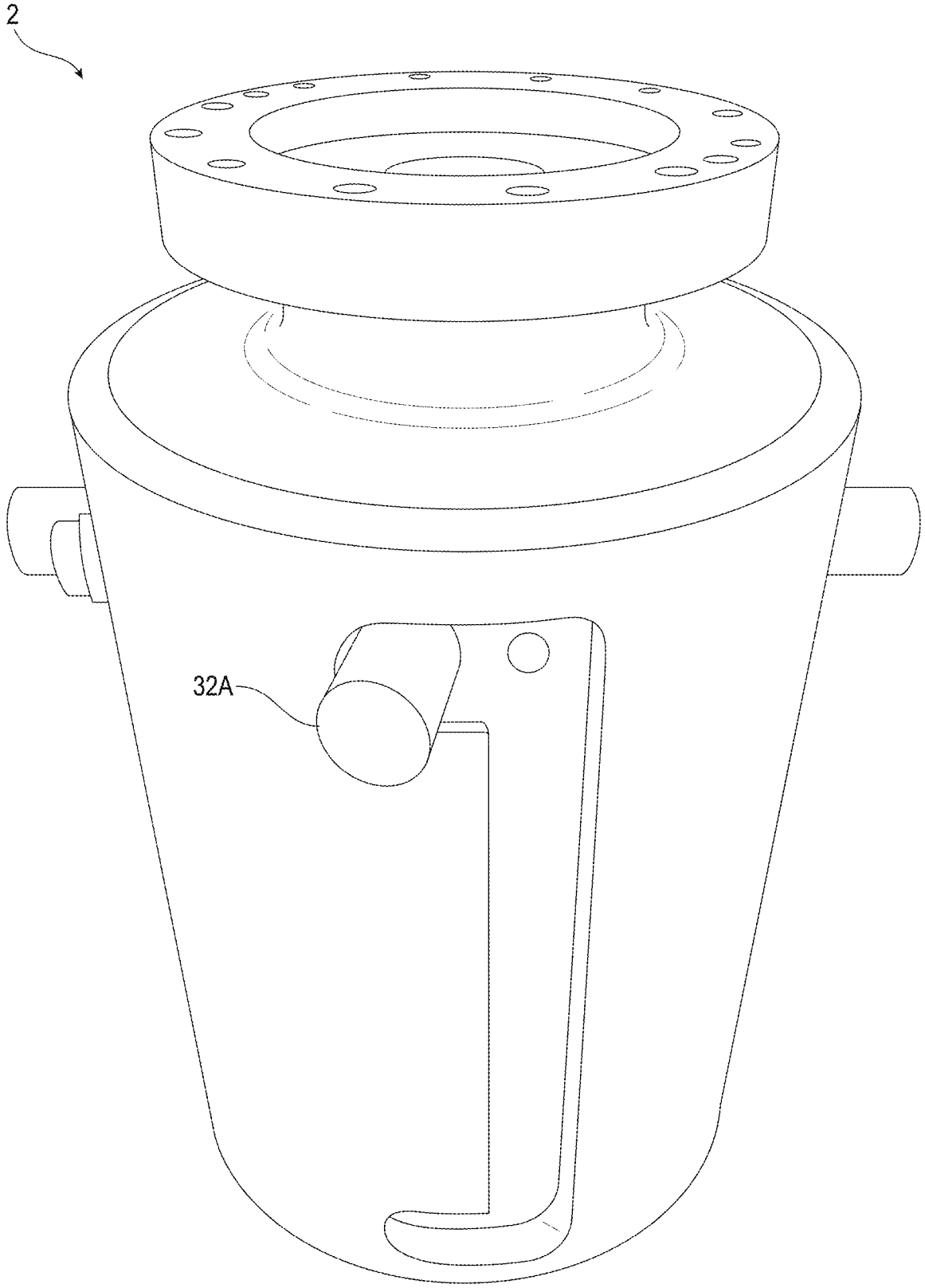
FIG. 9 is a left side perspective view of the collapsible casing tightener of FIGS. 1-3.

FIG. 8 provides another perspective view of a collapsible casing tightener of the present invention which provides additional detail in particular of features 32B, 35, 36 and 37, which enables the internal movable features to remain secured in position during transport or prior to use according to FIGS. 4-7, while FIG. 9 illustrates a side opposite to FIG. 8 with 32A protruding.

Although the present subject matter has been described with reference to specific exemplary embodiments, it will be evident that various modifications and changes may be made to these embodiments without departing from the broader spirit and scope of the subject matter. Accordingly, the specification and drawings are to be regarded as illustrative rather than exhaustive or to limit the invention to the precise forms disclosed. Many variations and modifications of the embodiments described herein will be obvious to one of ordinary skill in the art in light of the above disclosure. The scope of the invention is to be defined only by the claims, and by their equivalents.

The invention claimed is:

1. A collapsible casing tightener, comprising:

an outer body having a hollow frustoconical main section open at one end and leading to a shoulder at another end, said shoulder leading to a reduced neck, a collar on said neck having a radial array of angularly spaced upward-facing non-threaded joints for bolt attachment to a drill rig, the main section of the outer body having a radial array of angularly-spaced notches each comprising an elongated aperture through a wall of the main section, a hollow pipe section extending coaxially within the main section; and attached to the neck, the hollow pipe section extending to a distal cylindrical receptacle having a threaded female joint; and an extendable inner body telescopically inserted into the outer body between the main section and hollow pipe section, the inner body having a plurality of pins affixed therein and carried within said notches for guided extension.

2. The collapsible casing tightener of claim 1, wherein each notch comprises a lengthwise elongate segment running a majority of the length of the main section and two short segments extending at approximately a right angle from a terminus end of a lengthwise elongate segment, wherein the length of the elongate segments defines a maximum extension distance of the extendable inner body.

3. The collapsible casing tightener of claim 1, wherein the at least one notch of the radial array of angularly spaced notches comprises a safety lock configured to block a corresponding pin from entering the lengthwise elongate segment of the corresponding notch.

4. The collapsible casing tightener of claim 3, wherein the safety lock comprises opposing flanges flanking the uppermost short segment of the at least one notch, the opposing flanges containing through holes for insertion of a hitch pin, wherein the hitch pin straddles the two flanges when inserted through the through holes blocks the corresponding pin of the inner body from entering the lengthwise segment of the at least one notch, thereby preventing inadvertent extension.

5. The collapsible casing tightener of claim 1, wherein the inner body is formed with a male threaded joint configured to engage with a casing section.

6. The collapsible casing tightener of claim 1, wherein the neck continues through the shoulder into the main section, where it is attached to the hollow pipe section, which in turn continues to a distal cylindrical receptacle having a threaded female joint.

7. The collapsible casing tightener of claim 6, wherein the threaded female joint is configured for screw-insertion of a drill rod.

8. The collapsible casing tightener of claim 6, wherein the threaded female joint is configured for screw-insertion of a drill segment.

9. A method of installing a micropile, the method comprising:

drilling a first casing segment and first drill rod segment into the ground and below an upper clamp using drill string that comprises an interlocking ring bit and pilot bit, then releasing the pilot bit by reversing and extracting the pilot bit, wherein the first casing segment is left-hand-threaded and the first drill rod segment is right-hand-threaded;

utilizing the collapsible casing tightener according to claim 1 to a drill rig at the collar by bolt attachment to the non-threaded joints;

loading a second drill rod segment into the collapsible casing tightener and rotating the second drill rod segment clockwise into engagement with the first drill rod segment in a lower clamp;

disengaging the second drill rod segment from the collapsible casing tightener by counterclockwise rotation;

inserting a second casing segment over the second drill rod segment;

lowering the collapsible casing tightener into engagement with the second casing segment, wherein the inner body of the collapsible casing tightener is telescopically extended until the collapsible casing tightener engages with the second casing segment, preventing the hollow pipe section of the collapsible casing tightener from engaging with the second drill rod; and rotating the drill rig and collapsible casing tightener counterclockwise to engage the second casing segment with the first casing segment.

10. The method of claim 9, further comprising repeating the steps of claim 9 until enough casing and drill rod segments have been utilized as needed to form the micropile.

* * * * *